United States Patent [19]

Watanabe

[11] Patent Number: 4,750,529

[45] Date of Patent: Jun. 14, 1988

[54] WEBBING FOR SAFETY BELT

[75] Inventor: Masao Watanabe, Shizuoka, Japan

[73] Assignee: Nippon Seiko Kabushiki Kaisha, Tokyo, Japan

[21] Appl. No.: 18,395

[22] Filed: Feb. 25, 1987

[30] Foreign Application Priority Data

Mar. 17, 1986 [JP] Japan ..... 61-37469[U]

[51] Int. Cl.[4] ..... D03D 5/00

[52] U.S. Cl. ..... 139/383 R; 428/193

[58] Field of Search ..... 139/383 R, 384 R, 420 R, 139/426 R; 428/192, 193, 257, 258

[56] References Cited

U.S. PATENT DOCUMENTS

| | | | |
|---|---|---|---|
| 2,672,168 | 3/1954 | Walters | 139/383 R |
| 2,800,927 | 7/1957 | Silberman et al. | 139/383 |
| 4,018,960 | 4/1977 | Berger et al. | 428/193 |
| 4,148,957 | 4/1979 | Berger | 428/193 |
| 4,174,738 | 11/1979 | Berger et al. | 139/384 R |
| 4,202,381 | 5/1980 | Bucher | 139/383 R |
| 4,502,513 | 5/1985 | Müeller | 139/383 R |
| 4,600,626 | 7/1986 | Ogata | 428/193 |
| 4,660,605 | 4/1987 | Koch | 139/420 R |

FOREIGN PATENT DOCUMENTS 53-2981 2/1978 Japan .

*Primary Examiner*—Henry S. Jaudon
*Attorney, Agent, or Firm*—Wegner & Bretschneider

[57] ABSTRACT

A webbing for a safety belt includes a main part and selvedges extending along both sides of the main part. The denier size of warp threads in the selvedges is smaller than that of warp threads in the main part. The denier size of weft threads in the main part is at least equal to that of the warp threads in the selvedges. The heat shrinkage percentage of the weft threads in the main part is greater than at least the heat shrinkage percentage of the warp threads in the main part.

7 Claims, 2 Drawing Sheets

WEBBING FOR SAFETY BELT

BACKGROUND OF THE INVENTION (1) Field of the Invention

This invention relates to a webbing for safety belts. Specifically, this invention relates to a webbing for seat belts in vehicles, seat belts in airplanes and safety belts employed when working at elevated spots.

(2) Description of the Prior Art

As prior art techniques relating to webbings for safety belts, reference may be had to U.S. Pat. No. 4,018,960 and Japanese Patent Publication No. 2981/1978 by way of example.

In the webbing for a safety belt (hereinafter called simply "webbing" for the sake of brevity) disclosed in U.S. Pat. No. 4,018,960, the selvedges of the webbing are each constructed in a tubular form and warp threads forming the tubular selvedge is made of threads having a greater elongation at break than warp threads in the other part, namely, the main part. Owing to the tubular structure of the selvedges of the webbing, the selvedges are soft, thereby bringing about an advantage that they are free from the drawbacks of angular webbings, in other words, they can avoid the wearing of the clothing of a man under protection and can protect exposed parts of the man from damages such as cuts. Since threads having a higher elongation at break than the warp threads in the other part, i.e., the main part are used as the warp threads of the selvedges, the cut-off of the selvedges is allowed to take place after the cut-off of the main part.

On the other hand, the webbing disclosed in Japanese Patent Publication No. 2981/1978 makes combined use of high tensile strength-low elongation threads and low tensile strength-low elongation threads. The high tensile strength-low elongation threads are connected in a slack state so that the webbing is allowed to be cut off stepwise owing to differences in cut-off load.

Although the webbings disclosed respectively in U.S. Pat. No. 4,018,960 and Japanese Patent Publication No. 2981/1978 demonstrate excellent performance in their breaking tests upon their inspection as final products, they are accompanied by such drawbacks that when combined with fittings and used as safety belts, their selvedges are abraded due to frictional contact of the webbings to the corresponding bent guides, filaments of threads which form the selvedges are therefore cut off to develop fluffing, the appearances of the webbings are hence impaired, the users of the webbings feel uneasy, and the rewinding of the webbings in their corresponding retractors is also troubled. In the case of the webbing described in U.S. Pat. No. 4,018,960 in particular, each selvedge is in a tubular form. Each tubular selvedge is bent and is collapsed soon or later into two plies, one being a front ply and the other a back ply. When the tubular selvedge undergoes sliding contact with a guide in a bent state, the warp threads in the back ply are loosened and are hence rendered susceptible to cutting-off of their filaments. As a result, the back ply undergoes more fluffing and the rewinding of the webbing into the corresponding retractor is troubled frequently. Namely, the webbing described in U.S. Pat. No. 4,018,960 is insufficient in durability. Of these problems, the fluffing problem can be reduced by increasing the density of the weft threads per unit length. However, this solution leads to new problems that the webbing becomes thicker in its entirety, the rewinding of the webbing itself into the corresponding retractor is troubled more often and a larger retractor is required.

SUMMARY OF THE INVENTION

An object of this invention is to solve the above-mentioned drawbacks and problems of the prior art, more specifically, to provide a webbing which has excellent resistance to abrasion without need for a larger retractor, is resistant to the cut-off of selvedge-forming threads, avoids the wearing of the clothing of a man under protection by the selvedges and the damages to the body of the man, and has soft feeling to the touch.

In one aspect of this invention, there is thus provided a webbing for a safety belt. The webbing comprises a main part and selvedges extending along both sides of the main part. The denier size of warp threads in the selvedges is smaller than that of warp threads in the main part. The denier size of weft threads in the main part is at least equal to that of the warp threads in the selvedges. The heat shrinkage percentage of the weft threads in the main part is greater than at least the heat shrinkage percentage of the warp threads in the main part.

In the webbing of this invention, the selvedges are formed thinner than the main part. The outer edges of the selvedges are smooth, and when worn as a safety belt, the outer edges are soft and their contact to the body of a man and his clothing are smooth. The webbing is bent by various guides and undergoes sliding movement relative to them. The webbing however does not develop filament cut-off through its frictional contact with such guides, so that fluffing is reduced. As a result, the useful life of the webbing is prolonged and its beautiful appearance is not lost over a long period of time. Owing to the extended period until the development of fluffing and the improved sliding contact to the guides, a further advantage has been brought about that the trouble in rewinding the webbing into the corresponding retractor is decreased.

Only three types of threads may be required as the warp threads for the main part, the warp threads for the selvedges and the weft threads for the selvedges respectively. This feature has brought about numeral advantages such that the control of the weaving step of the webbing is facilitated and the production cost of the webbing is reduced.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENT

Figure 1:
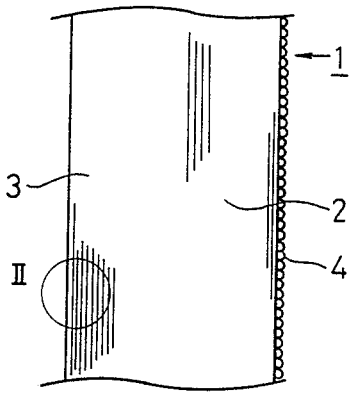
FIG. 1 is a fragmentary plan view of a webbing according to one embodiment of this invention.
Figure 2:
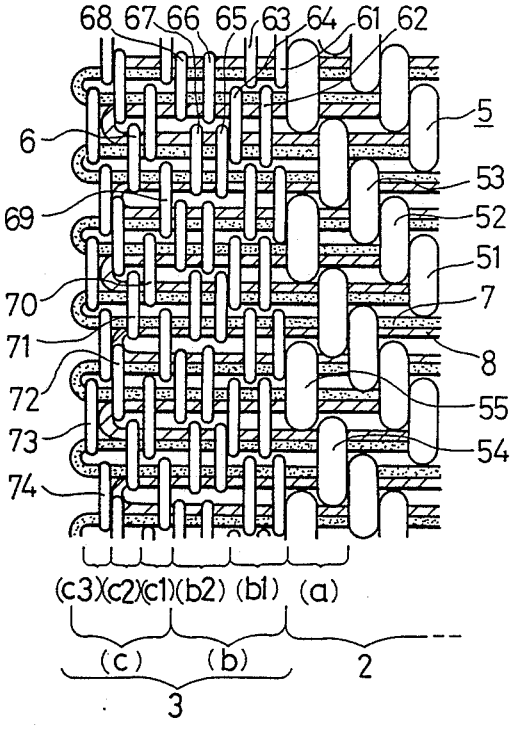
FIG. 2 shows on an enlarged scale the weave pattern of the portion indicated by II in FIG. 1.

Referring first to FIGS. 1 and 2, there is shown a webbing 1. Numeral 2 indicates a main part of the webbing 1 while numerals 3,4 indicate selvedges of the webbing 1. The denier size of warp threads 6 in the selvedge 3 is smaller than that of warp threads 5 in the main part 2. The denier size of weft threads 7,8 (the weft threads 7,8 are formed of a single continuous thread but are designated by the different reference numerals because their turned positions are different) is either equal to or larger than that of the warp threads 6 in the selvedge 3. The warp threads 6 and weft threads 7,8 are woven together. In addition, the heat shrinkage percentage of the weft threads 7,8 is greater than that of the warp threads 5 in the main part 1.

The denier size of the warp threads 6 in the selvedge 3, the denier size of the warp threads 5 in the main part 2 and the denier size of the weft threads 7,8 as well as the heat shrinkage percentage of the weft threads 7,8 and the heat shrinkage percentage of the warp threads 5 in the main part 2 are specified as described above. By applying a heat treatment to the webbing 1 upon dyeing same subsequent to the weaving of the webbing 1 or in an independent step, the weft threads 7,8 are hence shrunk. As a result, the warp threads 6 of the selvedge 3 are pulled toward the main part 2, the finished weave of the selvedge is densified, and warp threads 73,74 are hence allowed to assume their positions either outside of the weft threads 7,8 so as to be located at the corresponding outer edge of the webbing or in alignment with the weft threads 7,8. In the thus-formed webbing 1, the selvedge 3 is thinner than the main part 2 and in addition, the warp threads 6 of the selvedge 3 are pulled by the weft threads 7,8 toward the main part 2 as described above. As a consequence, the edge of the webbing 1 is rounded. When the webbing is brought into contact with the clothing or body of a man under protection or with a guide, the webbing is allowed to slide smoothly so that its friction and abrasion are reduced. Since the selvedge 3 is not in two plies like a tubular structure but is in a single ply, the warp threads 61–74 are not loosened and the cut-off of filaments forming the warp threads 61–74 can be reduced substantially. As a result, the beautiful appearance of the webbing can be maintained over a prolonged period of time and its smooth rewinding in the corresponding retractor can be achieved for a long period of time. The webbing 1 is hence usable over a long period of time and its replacement cycle can hence be prolonged.

In the above-described webbing 1 of this invention, the elongation at break of the warp thread 6 in the selvedge 3 is either equal to or greater than that of the warp threads 5 in the main part. When the heat shrinkage percentage of the warp threads 6 in the selvedge 3 is either equal to or smaller than that of the warp threads 5 in the main part 2, the selvedge 3 is not hardened but gives good feeling to the touch when the webbing 1 is subsequently subjected to a heat treatment upon its dyeing or to another heat treatment.

In the webbing of this invention, it is preferable to use threads, the filaments of which have a denier size in a range of from 8 denier to 14 denier, as the warp threads 6 of the selvedge 3 and the weft threads 7,8. By definition, individual filaments have a continuous length. If the filaments are finer than 8 denier, more filament cut-off may be induced. If the filaments are greater in diameter than 14 denier on the other hand, the selvedge 3 becomes harder and may impair the feeling to the touch upon its contact with the body and clothing of the man under protection.

At least two warp threads 54,55 of the main part 2, said at least two warp threads 54,55 extending in adjacent to the selvedge 3, are formed into a 2-up/2-down plain weave in the above-described webbing of this invention, whereby the main part 2 and selvedge 3 are smoothly united together, the edges of the webbing 1 are rendered smoother and the frictional resistance between the webbing and guides is reduced.

Further, the four warp threads 61,62,63,64 of the selvedge 3, said warp threads extending in adjacent to the main part 2, are formed as a unit into a 2-up/2-down plain weave b1 and the next four warp threads 65,66,67,68 are also formed as a unit into a 2-up/2-down plain weave b2, thereby forming a plain weave b. The plain weave b hence includes as a set at least two plain weaves b1,b2 each of which is formed of four warp threads. In adjacent to the plain weave b, warp threads are formed in units of two, as the warp threads 69,70, the warp threads 71,72 and the warp threads 73,74, into 2-up/2-down plain weaves c1,c2,c3 respectively so as to form a plain weave c. By arranging as a set at least two plain weaves each of which is of the same type as the plain weaves c1,c2,c3, the warp threads 6 of the selvedge 3 are united tight so that the cut-off of filaments of the threads due to their friction against with the guides can be reduced and the useful life of the webbing can be prolonged.

As to the denier size of the warp threads 6 of the selvedge 3, it is preferable to use threads having a denier size one half or smaller of the denier size of the warp thread 5 of the main part 2. Synthetic fibers of 1,000–1,500 denier are preferred as the warp threads 5 of the main part 2 where the synthetic fibers are polyester fibers, while synthetic fibers of 250–500 denier are preferred as the warp threads 6 of the selvedge 3.

Synthetic fiber threads having a denier size either equal to or larger than the warp threads 6 of the selvedge 3 are used as the weft threads 7,8. If they are too large in diameter, the weft threads 73,74 may protrude outwardly from the warp threads 73,74 of the selvedge 3. It is hence recommended to use threads having a fineness not causing such protrusion.

Polyester fibers, polyamide fibers or the like are used as the above-mentioned synthetic fibers. Polyester fibers are excellent in view of the strength, softness and flexing resistance of the webbing and the possibility of formation of the main part 2 of the webbing with a reduced thickness, and are thus used preferably.

[EXAMPLES]

Example 1

Using polyester fibers, a webbing depicted in FIGS. 1 and 2 was woven.

Figure 3:
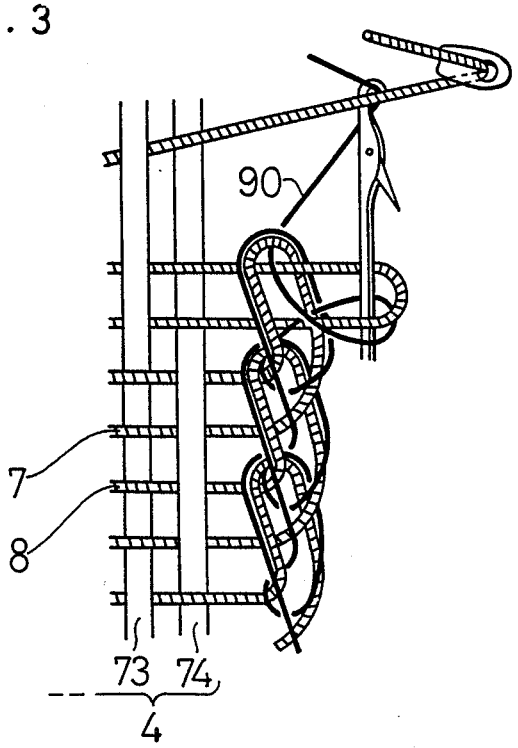
FIG. 3 illustrates by way of example the structure of a knitted selvedge.

As the warp threads 5 of the main part 2, threads each of 1260 denier and 108 filaments were used. As the warp threads 6 of the selvedge 3, threads each of 250 denier and 24 filaments were employed. Threads each of 500 denier and 48 filaments were used as the weft threads 7,8. In the selvedge 4 (i.e., in the knitted selvedge), end loops were formed by the weft threads 7,8 and an intertwining thread, also known as a catch thread, 90 of 25 denier and 24 filaments was knitted in the loops as a fraying stopper (see, FIG. 3); the weave shown in FIG. 3 is similar to the weave taught in U.S. Pat. No. 2,800,927.

As the warp threads 6 of the selvedge 3, there were used threads having a dry heat shrinkage percentage (at 150° C.) about 66% lower than the dry heat shrinkage percentage (at 150° C.) of the warp threads 5 of the main part 2. As the weft threads 7,8 on the other hand, threads having a dry heat shrinkage percentage (at 150° C.) 18% greater than the dry heat shrinkage percentage (at 150° C.) of the warp threads 5 of the main part 2 were employed.

The thus-woven webbing was heated upon dyeing same in a dyeing step so that the fixing of a dye and a heat treatment were effected at the same time.

The thus-obtained webbing was used as a vehicle seat belt. The feeling of the selvedges to the touch was smooth. While the webbing was in direct contact with the body, the seat belt was put on and taken off and the vehicle was driven. Absolutely no damages were given to the body so that the seat belt employing the webbing of this invention was able to reduce the unpleasant feeling due to the wearing of the seat belt compared with conventional seat belts.

Regarding characteristic properties of the webbing, an investigation was performed in accordance with the testing methods prescribed in the Japanese Industrial Standards. As a result, the webbing was able to pass all the tests. It was still able to pass all the tests even when the testing conditions were rendered severer by 20% or more. In an abrasion resistance test against a slip guide, fluffing occurred neither at the main part 2 nor at the selvedge 3. During the durability test, the rewinding of the webbing into the corresponding retractor was free of trouble and was effected smoothly.

Example 2

Figure 4:
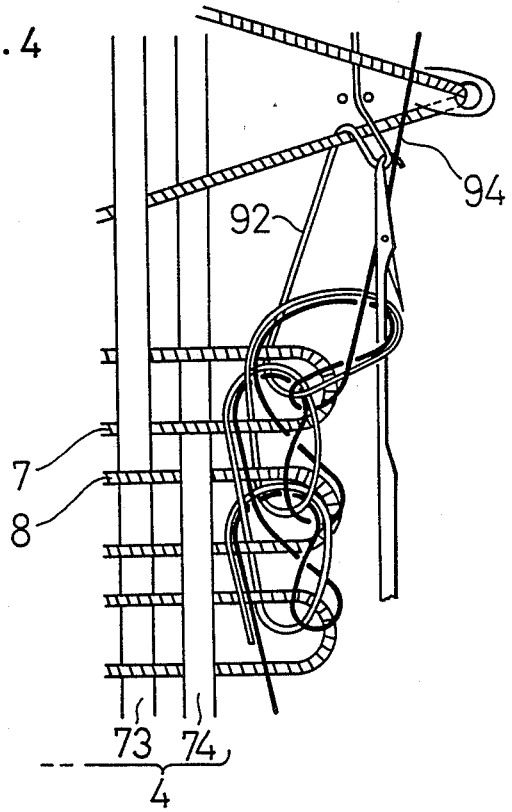
FIG. 4 shows by way of example the structure of another knitted selvedge.

A webbing was produced in the same manner as in Example 1 except that a single polyester fiber thread of 250 denier and 24 filaments was used as a knitted selvedge thread 92 forming a knitted selvedge and the knitted selvedge was formed by forming loops with the knitted selvedge thread 92, holding the weft threads by the loops and then knitting an intertwining thread 94 (100 denier and 18 filaments) as a fraying stopper in the loops (see, FIG. 4); the weave shown in FIG. 4 is similar to the weave taught in U.S. Pat. No. 4,202,381.

In the resultant webbing, the selvedges were thin and dense in their entirety. The loops of the knitted selvedge were extremely small compared with those in conventional webbings and were formed in close contact with the associated warp threads. Substantially the same results were obtained as to the individual characteristic properties of the webbing.

Having now fully described the invention, it will be apparent to one of ordinary skill in the art that many changes and modifications can be made thereto without departing from the spirit or scope of the invention as set forth herein.

I claim:

1. In a webbing for a safety belt, said webbing comprising a main part and selvedges extending along both sides of the main part, the improvement wherein the denier size of warp threads in the selvedges is smaller than that of warp threads in the main part, the denier size of weft threads in the main part is at least equal to that of the warp threads in the selvedges, and the heat shrinkage percentage of the weft threads in the main part is greater than at least the heat shrinkage percentage of the warp threads in the main part.

2. The webbing as claimed in claim 1, wherein the elongation at break of the warp threads in the selvedges is at least equal to that of the warp threads in the main part and the heat shrinkage percentage of the warp threads in the selvedges is at most equal to that of the warp threads in the main part.

3. The webbing as claimed in claim 1, wherein the filaments forming the warp threads and weft threads in the selvedges are synthetic filaments having a denier size of from 8 to 14 denier.

4. The webbing as claimed in claim 1, wherein at least two outermost warp threads in the main part adjacent to each of the selvedges extend adjacent to each other and form a 2-up/2-down plain weave.

5. The webbing as claimed in claim 1, wherein in each of the selvedges, warp threads extending adjacent to the corresponding edge of the main part are formed in at least two units of four in a 2-up/2-down plain weave and warp threads extending adjacent to the plain weaves are formed in at least two units of two in a 2-up/2-down plain weave.

6. The webbing as claimed in claim 1, wherein one of the selvedges is formed by end loops of the weft threads and a catch thread as a fraying stopper for the loops.

7. The webbing as claimed in claim 1, wherein one of the selvedges is formed by end loops of the weft threads, a woven selvedge thread extending through the end loops and forming additional loops, and a catch thread as a fraying stopper for the woven selvedge thread.

* * * * *